US009297098B2

(12) United States Patent
Stevens et al.

(10) Patent No.: US 9,297,098 B2
(45) Date of Patent: Mar. 29, 2016

(54) FOLDABLE REINFORCING WEB

(75) Inventors: Glenn A. Stevens, St. Catharines (CA); Charles G. Herbert, Shrewsbury, MA (US)

(73) Assignee: Saint-Gobain ADFORS Canada, Ltd., Grand Island, NY (US)

( * ) Notice: Subject to any disclaimer, the term of this patent is extended or adjusted under 35 U.S.C. 154(b) by 1111 days.

(21) Appl. No.: 12/780,265

(22) Filed: May 14, 2010

(65) Prior Publication Data

US 2010/0304114 A1 Dec. 2, 2010

Related U.S. Application Data

(63) Continuation of application No. PCT/US2008/087343, filed on Dec. 18, 2008.

(60) Provisional application No. 61/014,942, filed on Dec. 19, 2007.

(51) Int. Cl.

| | |
|---|---|
| ***B32B 5/02*** | (2006.01) |
| ***C09J 5/00*** | (2006.01) |
| ***D04H 1/4218*** | (2012.01) |
| ***D04H 1/58*** | (2012.01) |
| ***D04H 1/645*** | (2012.01) |

(52) U.S. Cl.

CPC ..... *D04H 1/4218* (2013.01); *D04H 1/58* (2013.01); *D04H 1/645* (2013.01); *Y10T 442/20* (2015.04)

(58) Field of Classification Search

CPC ..... D04H 1/4218
USPC ..... 428/195.1
See application file for complete search history.

(56) References Cited

U.S. PATENT DOCUMENTS

| | | | | |
|---|---|---|---|---|
| 4,269,886 | A * | 5/1981 | Bondoc | C03C 25/00 428/141 |
| 5,017,312 | A | 5/1991 | Peters et al. | |
| 5,418,027 | A | 5/1995 | Conboy | |
| 5,486,394 | A | 1/1996 | Stough | |
| 5,865,003 | A | 2/1999 | Klett et al. | |
| 6,817,152 | B2 * | 11/2004 | Peng et al. | 52/514 |
| 7,141,284 | B2 | 11/2006 | Newton et al. | |
| 2003/0186037 | A1 | 10/2003 | Edge et al. | |

(Continued)

FOREIGN PATENT DOCUMENTS

| | | | |
|---|---|---|---|
| GB | 1214154 | | 12/1970 |
| GB | 2247031 | A | 2/1992 |
| WO | 95/16562 | A1 | 6/1995 |
| WO | 2005058595 | A1 | 6/2005 |
| WO | 2006/124092 | A1 | 11/2006 |
| WO | WO 2009/085901 | | 7/2009 |

OTHER PUBLICATIONS

Supplementary European Search Report for corresponding application No. EP 08 86 6360 dated Aug. 22, 2012, 1 page.

(Continued)

*Primary Examiner* — Ian Rummel
(74) *Attorney, Agent, or Firm* — Abel Law Group, LLP; Robert N. Young

(57) ABSTRACT

A reinforcing web has multiple fibers joined together with a binder. At least some of the fibers have foldable portions, wherein the foldable portions have substantially less binder thereon to increase flexure to fold the web. A method of making the reinforcing web includes, applying a binder on the web, and removing some or all of the binder from a foldable portion of the web prior to curing the binder that remains on the web.

29 Claims, 8 Drawing Sheets

(56) References Cited

U.S. PATENT DOCUMENTS

| | | | | |
|---|---|---|---|---|
| 2005/0014434 | A1 | 1/2005 | Zillig et al. | |
| 2006/0099870 | A1 * | 5/2006 | Garcia et al. | 442/374 |
| 2007/0099524 | A1 | 5/2007 | Porter | |
| 2008/0034694 | A1 | 2/2008 | Banta | |
| 2008/0139064 | A1 | 6/2008 | Neill et al. | |

OTHER PUBLICATIONS

International Search Report for corresponding application No. PCT/US2008/087343 dated Jun. 29, 2009, 1 page.

ASTM International, "Standard Specification for Asphalt Shingles Made from Glass Felt and Surfaced with Mineral Granules", Nov. 30, 2007, 5 pages.

* cited by examiner

FOLDABLE REINFORCING WEB

CROSS REFERENCE TO RELATED APPLICATION

This application is a continuation of PCT Application PCT/US2008/87343, filed Dec. 18, 2008 (D1815-00305), which claims the benefit of U.S Provisional Application No. 61/014,942, filed Dec. 19, 2007 (D1815-00294).

FIELD OF THE INVENTION

The invention relates to a reinforcing web to reinforce a cementitious wallboard or to reinforce a wallboard joint compound, and a method of making the reinforcing web, as well as, a reinforcing web in a wallboard or in a wallboard joint.

BACKGROUND

The terminology, wallboard, refers to one or more panels or panel sections having major surface areas, which form gypsum wallboard or, alternatively, portland cement wallboard or alternatively, in situ polymeric foam panels of US 2007/0099524 A1. U.S. Pat. No. 5,017,312 discloses chopped glass fiber mats tested for flexure and tensile properties according to ASTM D 790-84a "Standard Test Methods for Flexural Properties of Unreinforced and Reinforced Plastics and Electrical Insulating Materials," and ASTM D 638-84 "Standard Test Method for Tensile Properties of Plastics." The tests are performed on mats having random oriented chopped fibers and mats having directionally oriented chopped fibers.

U.S. Pat. No. 7,141,284 B2 discloses a reinforcing web having a rewettable coating to solubilize in a slurry of a joint compound and form an adhesive bond with the joint compound.

Open wallboard seams are formed between abutting sections of gypsum wallboard that meet side-by-side, or that meet at inside corners. To fill and cover an open wallboard seam, a wallboard joint is constructed, by applying a joint compound reinforced with an imbedded reinforcing tape. Additional seams can appear as cracks in the wallboard, which are repaired by constructing wallboard joints.

The joint compound is in the form of a shapeable slurry that fills the seam. The reinforcing tape is applied to extend across the filled seam, and to overlap the edge margins of the wallboard abutting the filled seam. It is desirable that the reinforcing tape is foldable to form a lengthwise crease. The crease is needed for conformance at an inside corner of a wall meeting another wall or a wall meeting a ceiling, wherein wallboard sections of the walls and ceiling meet one another at an angle less than 180 degrees. A wallboard joint is constructed at the inside corner by applying joint compound to imbed the creased reinforcing tape.

A joint tape made of paper is capable of forming a crease for installation at inside corners wherein wallboard sections meet one another at an angle of less than 180 degrees. Moreover, commercial tooling has been developed to use paper tape for machine construction of a wallboard joint. The tooling continuously dispenses the paper tape and continuously dispenses a joint compound slurry to imbed the tape. Further, the tooling shapes and smoothes the joint compound slurry. A drawback of paper tape is that the paper is weakened by becoming saturated with water from the slurry, and is incapable of passing air bubbles that are trapped behind the paper tape during construction of a wallboard joint.

Instead of a paper tape, a fabric tape has been used to reinforce a joint compound. A thin porous fabric has been manufactured with random laid glass fibers adhered to one another with a urea-formaldehyde binder. The tips of the glass fibers tend to poke out, which is irritating to the touch when handled by a worker. Moreover, a binder coated fabric resists being folded, and is not able to form a crease for conformance to an inside corner. Further, the binder covered fabric is not adaptable as is paper for handling by machine tooling for fabricating a wallboard joint. Such drawbacks deter using a binder coated fabric for reinforcing a joint compound.

SUMMARY OF THE INVENTION

A reinforcing web for imbedding at least partially in a cementitious material that hardens from a slurry form includes multiple fibers joined together by a binder. At least some of the fibers have foldable portions, wherein the foldable portions have less binder composition thereon to increase flexure while folded without forming a crease or while folded to form a crease, and the foldable portions extend over a lengthwise central section of the web.

According to embodiments of the invention, the reinforcing web reinforces either a cementitious board or a wallboard joint compound.

According to an embodiment of the invention, a planar section of the web reinforces a major surface of a wallboard, and foldable portions of the web are of increased flexure to be foldable over lateral edges of a wallboard to reinforce the lateral edges.

According to another embodiment of the invention, a lengthwise central section of the web is foldable to form a crease for conformance to an inside corner formed by a wallboard joint compound.

A method of making a reinforcing web comprises, applying a binder onto multiple fibers, wherein the fibers are oriented lengthwise in multiple directions, including random directions, predetermined directions, or a combination thereof to form a non-woven web, removing at least some of the binder from foldable portions of at least some of the fibers to increase flexure of the foldable portions at a fold of the foldable portions, and joining the fibers to one another by curing the binder thereon to resist tensile forces exerted in said multiple directions.

According to an embodiment of the method includes, removing substantially all of the binder from foldable portions of at least some of the fibers to increase flexure of the foldable portions at a fold of the foldable portions and to form a crease in the fold.

BRIEF DESCRIPTION OF THE DRAWINGS

Embodiments of the invention will now be described by way of example with reference to the accompanying drawings.

DETAILED DESCRIPTION

Figure 1:
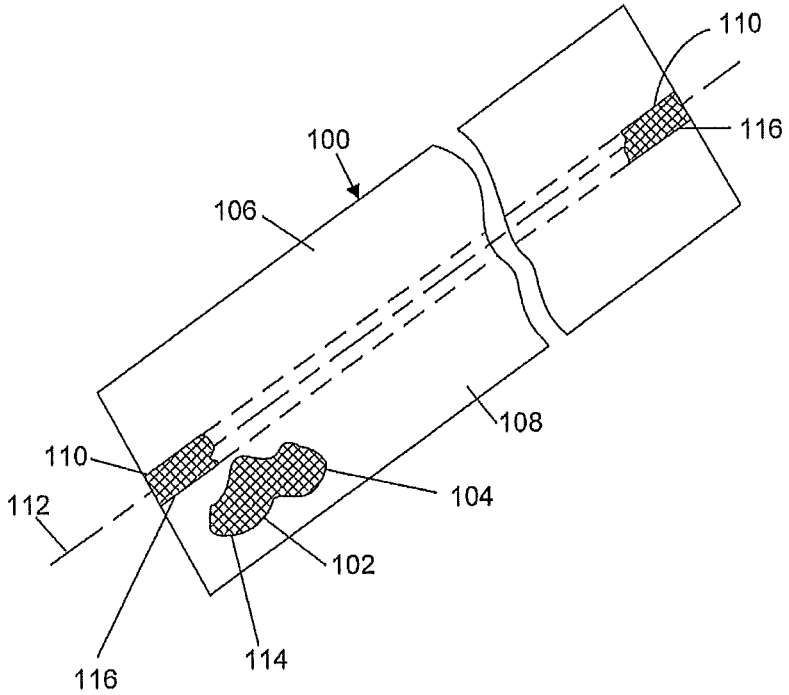
FIG. 1 is a schematic view of a first embodiment of a reinforcement tape.

The invention relates to a fiber reinforcement web to at least partially imbed in a cementitious material, and methods for making the same. The reinforcement web is at least partially embedded in the cementitious material that is hardened from a slurry form to form a wallboard. The fiber reinforcement web permeability enables penetration by the cementitious material in slurry form to at least partially imbed the web in the cementitious material to reinforce the cementitious material. The imbedded web reinforces the hardened cementitious material, adding to its flexural strength and its tensile strength, i.e. resistance to deflection and resistance to cracking and fracture due to strain induced by external tensile forces and/or due to internal strain.

The relative permeability of the web, due to the sizes of pores or spaces between the fibers, and the relative viscosity of the slurry determine to what extent the web becomes imbedded in the slurry. A web of lower permeability, smaller pores or spaces between the fibers, promotes penetration of a lower viscosity slurry and tends to imbed at the surface of a lower viscosity slurry, particularly for a slurry mixture of the lower viscosity slurry and a higher viscosity slurry. A web of higher permeability, larger pores or spaces between the fibers, can promote penetration of a lower viscosity slurry, and can embed deeper, below the surface of the slurry. Further, a web of higher permeability is required to promote penetration of a higher viscosity slurry.

A slurry wetting agent applied to coat the fibers further promotes wetting of the fibers by the slurry together with penetration of the web by the slurry. A solvent activated adhesive coating on the fibers further promotes adherence of the fibers to a hardened cementitious material. For example, water is a solvent of a gypsum cementitious slurry or of an alkali cementitious slurry, which activates a water activated adhesive coating on the fibers to and adhesive state for adherence to a hardened wallboard or hardened joint compound.

Further, the invention relates to a reinforcement web to reinforce a cementitious material, wherein the web is constructed with a varied flexibility for foldability and creasability and for achieving a result including but not limited to, bending the web and/or folding the web and/or creasing the web to conform the web to the shape or shapes of the cementitious material being reinforced by the web.

The fiber reinforcement web is constructed for flexibility or flexure, foldability and creasability at one or more selected locations on the web. The flexibility or flexure, foldability and creasability varies across the width of the web or alternatively in another direction.

The fiber reinforcement web is constructed with chopped reinforcement fibers bonded together by a binder composition dispersed among the fibers and cured, i.e., solidified, to bond the fibers together. The binder composition is dispersed with a lower binder mass distribution and a higher binder mass distribution in respective continuous lines or continuous areas that extend lengthwise of the web or alternatively in another direction.

The lines or areas extend continuously throughout a dimensional measurement of the web area to include the web thickness, such that a section of the web within the lines or areas including the web thickness is constructed with relatively less binder composition to adjust or induce flexibility, foldability and creasability. Alternatively, the section of the web is constructed with substantially less binder composition to adjust or induce foldability and/or creasability. In the section of the web, the binder composition is dispersed with a relatively lower binder mass distribution than elsewhere in the web.

The fiber reinforcement web is made with a selected thicknesses. According to an embodiment of the invention, a fiber reinforcement web having a maximμm thickness of a paper drywall tape is adapted for use in fabricating a drywall joint. The drywall tape is creased lengthwise for conformance to an inside corner. According to another embodiment of the invention, a fiber reinforcement web having a thickness of a wallboard facing sheet is adapted for use in fabricating a cementitious wallboard. The fiber materials, lengths and thickness, the web permeability and thickness, and the binder composition viscosity are selective to promote penetration of the intended slurry composition and adherence of the fibers to the cementitious composition. The fiber materials, lengths and thickness, and the web thickness are selected to promote flexure strength and tensile strength of the fiber reinforced cementitious.

FIG. 1 discloses a thin non-woven reinforcement web 104 of multiple fibers 102 in which the fibers 102 are laid non-woven to provide a reinforcement tape 100. For purposes of illustration a small section of the web 104 is disclosed to indicate the fibers 102. The fibers 102 comprise a high tensile strength material, including but not limited to glass or a polymer, for example, a polyester. Further, the fibers 102 are water resistant when manufactured of glass, a crystalline polymer or a thermoset polymer. The fibers 102 are alkali resistant when manufactured of either AR glass or polymer coated glass.

According to an embodiment of the invention, the fibers 102 are chopped or severed to lengths of about 0.75 inch (19.05 mm.) to about 1.5 inch (38.100 mm.). The fiber diameters comprise one of about, 11 μmm., 13.5 μmm. or 16 μmm. The distribution of the fibers 102 in the web 104 provides a web thickness preferably equal to that of a commercially available, cellulosic paper joint tape, about 0.18 mm., plus or minus allowable dimensional tolerances. The web 104 has a width of about 2 inches (50 mm.) desirably about equal to or less than that of a commercially available, paper joint tape. Thereby, the web 104 has dimensions capable of substituting for a paper tape that is used in commercial tooling to fabricate a wallboard joint.

Further, the distribution of spaces between adjacent fibers 102 provides the web 104 with openings for passage of a commercially available joint compound in slurry form during a process of imbedding the web 104 in the slurry to make a wallboard joint.

Further, the web 104 in the form of a joint tape 100 is of continuous length, and has lengthwise lateral sections 106, 108 adjoining a lengthwise central section 110 that encompasses a lengthwise central axis 112 of the web 104. The fibers 102 in the lengthwise lateral sections 106, 108 are joined together by a binder composition 114 thereon. The binder composition 114 joins the fibers 102 with one another. The fibers 102 in the web 104 are laid flatly and extend in multiple directions, including random directions, predetermined directions, or a combination thereof to resist tensile forces exerted in such multiple directions. Thereby, the fibers 102 resist tensile forces exerted in said directions when the fibers 102 are imbedded in a joint compound. The joint compound will be reinforced by the imbedded fibers 102 of the web 104 to resist cracking under stress when forces are exerted on a wallboard joint formed by the reinforced joint compound. Spaces among the fibers 102 provide passages through the web 104 for passage of joint compound slurry. As an advantage compared to paper joint tape, the passages permit escape of air from being trapped behind the web 104. The fibers 102 provide a web 104 that comprises a non-woven mat or fleece in which the fiber lengths lie flatly in the thickness plane of the web 104, and extend lengthwise in multiple directions, including random directions, predetermined directions, or a combination thereof.

The lengthwise central section 110 of the web 104 is about 1 mm. to about 3 mm. wide. The lengths of respective fibers 102 are less than the overall width of the web 104. The lengths of respective fibers 102 are greater than the width of the central section 110 of the web 104. The web 104 of the present invention must be capable of lengthwise folding to form a crease. The crease is needed for conformance at an inside corner where two sections of wallboard meet at an angle less than 180 degrees.

In an embodiment of the invention, the lengthwise central section 110 is foldable to form a lengthwise crease, extending preferably along the axis 112. The fibers 102 that have the binder composition 114 thereon tend to resist being creased. Thus, some of the fibers 102 have foldable portions 116 that extend over the central section 110, and are free of the binder composition 114 so as to crease upon being folded. In an alternative embodiment of the invention, the foldable portions 116 of at least some of the fibers 102 in the lengthwise central section 110 have less binder composition 114 thereon than do the fibers 102 in the lengthwise lateral sections 106, 108, so as to crease upon being folded.

The lengths of the fibers 102 are less than the overall width of the web 104. The lengths of the fibers 102 are greater than the width of the central section 110, such that the fiber lengths extend in the central section 110, further project outwardly from the central section 110, and into at least one lateral section 106, 108, wherein they are joined with other fibers 102 by having the binder composition 114 thereon.

Construction of a wallboard joint is performed either by manipulating hand tools, or by using commercial machine tooling. A paper type joint tape can be manually handled by a human worker who applies the tape by hand, and uses hand tools to imbed the tape in a slurry of joint compound, and to spread and smooth the joint compound to make a wallboard joint.

Alternatively, commercial machine tooling continuously applies a joint compound slurry and a paper type joint tape while continuously imbedding the paper type joint tape in the slurry, and spreading and smoothing the joint compound to make a wallboard joint.

Figure 2:
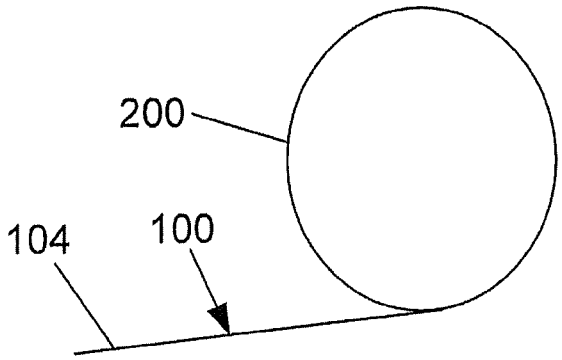
FIG. 2 is a schematic view of a roll of tape according to one of the embodiments of a reinforcement tape.

An embodiment of the tape 100 according to the invention is intended as a replacement for paper type joint tape for use in commercial machine tooling or for manual handling, to make a wallboard joint. Accordingly, an embodiment of the web 104 has about the same dimensions as the paper type joint tape, or less. Further, the web 104 has a suppleness about that of paper tape for ease in handling and constructing a wallboard joint by hand tools or commercial machine tooling. Further, the web 104 of the present invention is rolled up on itself, FIG. 2, while in the form of a reinforcing tape 100, and undergoes unrolling from a roll 200 of the tape 100, for application onto a wallboard joint and imbedding in a joint compound slurry.

The web 104 must be capable of forming a crease for installation and conformance at an inside corner. Further, the web 104 of the present invention must have smooth fiber surfaces to avoid irritation to a human skin while being handled by a worker.

A process of making the reinforcement web 104 or tape 100 will now be described. The fibers 102 are chopped or severed to lengths of about 0.75 inch (19.05 mm.) to about 1.5 inch (38.100 mm.). The fibers 102 are commercially purchased as chopped fibers 102.

Figure 3A:
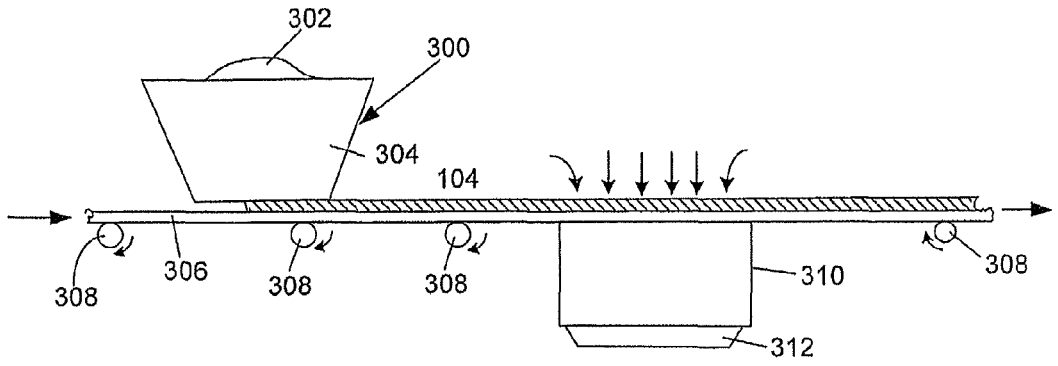
FIG. 3A is schematic view of a portion of a manufacturing system and apparatus.
Figure 3B:
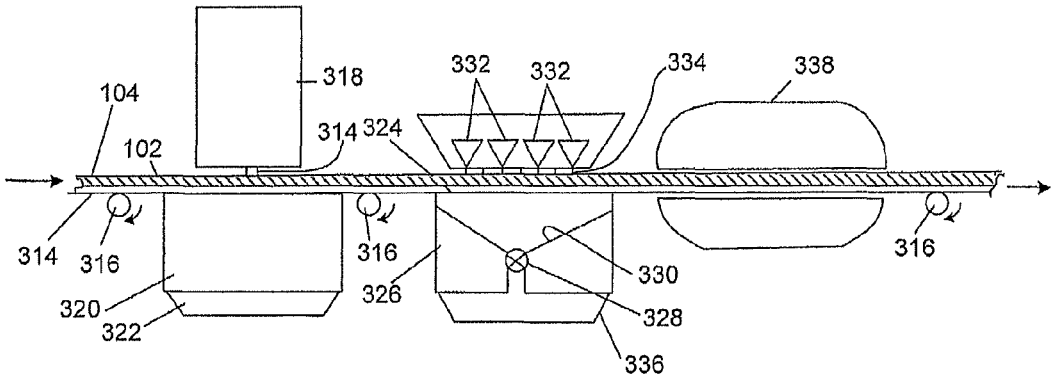
FIG. 3B is a schematic view of another portion of a manufacturing system and apparatus.

FIGS. 3A and 3B disclose a system and apparatus 300 to manufacture the web 104 and/or reinforcing tape 100. In FIG. 3A, the short length fibers 102 are commercially purchased and are amassed into a slurry 302 by mixing with a slurry solution comprised of water enhanced with a surfactant and a viscosity increaser. The slurry 302 comprises 0.1212% solids of a soluble surfactant and 0.0072% solids of a soluble viscosity enhancer and water to total 102,000 gallons (386,112 liters) of slurry solution mixed with fibers 102. The slurry 302 comprises an agglomerate of the fibers 102 and slurry solution, and is capable of settling or slumping to form a thin and uniform layer. The slurry 302 emerges from a head box dispenser 304 that uniformly distributes the slurry 302 in a uniform layer on a forming wire 306. The forming wire 306 comprises a perforated, non-woven flat fabric of a non-stick material, such as, polytetrafluoroethylene (PTFE). The non-woven fibers 102 of the slurry 302 are wet laid flatly on the forming wire 302, and extend lengthwise in multiple directions, including random directions, predetermined directions, or a combination thereof to form the non-woven web 104. The fibers 102 in the web 104 are held together by the slurry solution, and by support against the forming wire 306, while the web 104 and forming wire 306 are conveyed by industry standard conveyers 308 to pass over a first vacuum box 310. The first vacuum box 310 removes excess solution by suction, impelling the water in the web 104 and ambient air downwardly, as indicated by the arrows, through the perforated forming wire 306. The removed solution is collected in a collection tank 312 for recycled use in the system 300. The fibers 102 are drawn against the forming wire 306 by the suction to form a web thickness about equal to that of a paper joint tape.

In FIG. 3B, the conveyed web 104 is then transferred from the forming wire 306 onto a saturator wire 314, of similar construction as the forming wire 306. The web 104 on the saturator wire 314 is conveyed by industry standard conveyors 316 and passes under a curtain coater 318 of the system and apparatus 300, which applies a falling, flowing curtain of fluent binder composition 114 onto the web 104. The binder composition 114 distributes among the fibers 102. The fluid binder coats the web 104 and adheres to the tips of the fibers 102, as well, to smooth the surfaces of the fibers 102 for non-irritating contact with a person's skin. The web 104 is conveyed continuously lengthwise while being coated with a solution of the binder composition 114.

In FIG. 3B, the web 104 while on the saturator wire 314 passes over a second vacuum box 320, directly aligned vertically under the curtain coater 318. The second vacuum box 320 draws a vacuum (reduced air pressure) to remove excess fluent binder composition 114 by suction from the fibers 102. The removed binder composition 114 is collected in a collection tank 322 for recycled use in the system 300. Essential amounts of the binder composition 322 remain on the fibers 102 for subsequent joining of the fibers 102 together in the binder coated portions of the web 104.

Further, in FIG. 3A, the saturator wire 314 and the conveyed, binder coated web 104 pass over a top surface 324 of a vacuum table 326. A motor driven vacuum pump 328 draws air from an interior 330 of the vacuum table 326, which draws a vacuum (reduced air pressure) in the interior 330 of the vacuum table 326, while one or more water jet nozzles 332 focus a stream of water 334 from above.

Figure 4:
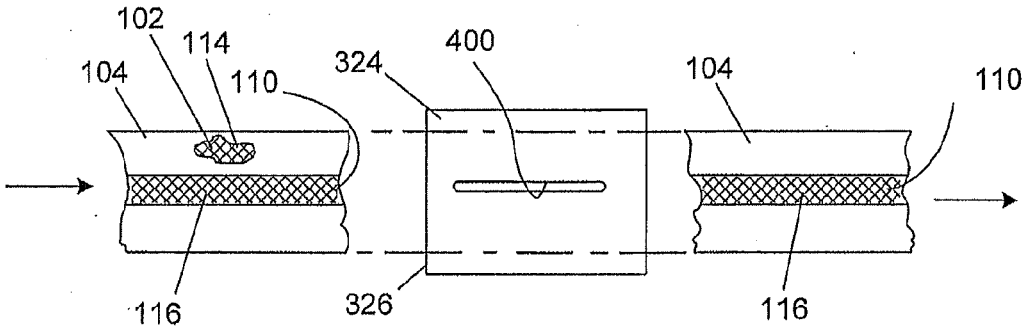
FIG. 4 is a schematic view of a vacuum table of a manufacturing system and apparatus.
Figure 4A:
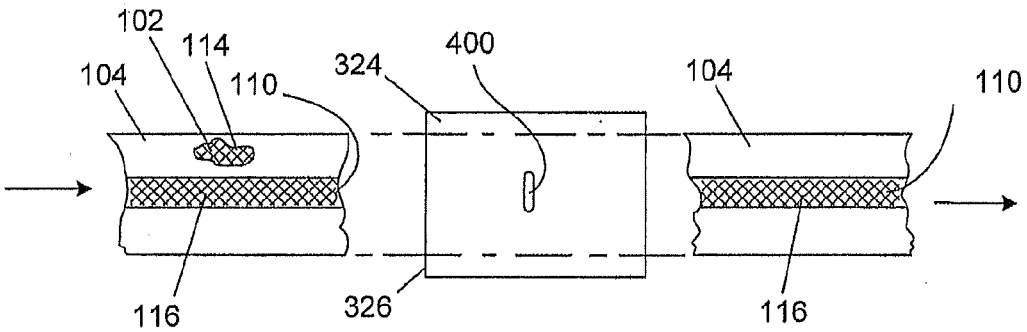
FIG. 4A is a view similar to FIG. 4 of another embodiment of a vacuum table.

In FIG. 4, the surface 324 of the vacuum table 326 has a lengthwise, narrow slot 400 over which the lengthwise central section 110 of the web 104 is conveyed. In preferred embodiment of the invention, The nozzles 332, in FIG. 3, focus the stream of water 334 in a narrow pattern aligned with the lengthwise slot 400 to impinge the lengthwise central section 110 of the web 104. Water is a solvent for the uncured binder composition 114. A solvent 334 other than water can be dispensed to impinge a binder composition 114 that is soluble in the solvent 334 other than water. Water dispenses from each water jet nozzle 322 and passes through the foldable portions 116 of the fibers 102 that extend into the narrow central section 110 of the web 104. The water is vacuum drawn by the reduced air pressure of the vacuum table 326, through the central section 110 of the web 104 and into the slot 400 of the vacuum table 326. FIG. 4A discloses the narrow slot 400 transverse or crosswise to the lengthwise central section 110. The stream of water 334 is focused in a narrow pattern by an appropriate number of the nozzles 332 of FIG. 4, to impinge the lengthwise central section 110 of the web 104. The web 104 is conveyed lengthwise at a speed sufficient to avoid spreading of the stream of water 334 beyond the narrow central section of the web 104 before the water is vacuum drawn into the slot 400 of the vacuum table 36. In FIGS. 4 and 4A, the water flows through the central section 110 of the web 104, which dilutes the water soluble binder composition 114 and removes at least some of the binder composition 114 from at least some of the foldable portions 116 of the fibers 102 to increase flexure and reduce stiffness thereof by reducing the amount of binder composition 114, and alternatively, removing substantially all of the binder composition 114 from such foldable portions 116 to permit folding and creasing of the foldable portions 116. Alternatively, the binder composition 114 is completely removed from the foldable portions 116 of the fibers 102 that are in the central section 110 of the web 104. The removed binder composition 114 is collected in a collection tank 336 for recycled use in the system 300. The binder removing operation is narrowly focused on, and confined to, the longitudinal central section 110 of the web 104 by the combined, focused water jet and the width of the narrow slot 400 through the surface 324 of the vacuum table 326. The non-removed binder composition 114 remains adhered to respective fibers 102.

In FIG. 3B, thereafter the web 104 is conveyed through a curing oven 338 at elevated temperature, such that the binder composition 114 on the fibers 102 is heated to a curing temperature, which drives off the solvent and solidifies the binder composition 114 to a thermoset state. The binder 114 is cured and set to a thermoset state, wherein the binder 114 is solidified and becomes insoluble in water and other solvents, and joins the fibers 102 together in the web 104. The web 104 is rolled up to form the roll 200 of reinforcement tape 100.

The binder composition 114 is cooled to ambient temperature after the web 104 leaves the curing oven 338. The binder composition renders the fibers 102 more supple to the touch. However, the binder coated fibers 102 resist flexure when folded and resist forming a crease when folded. Moreover, the binder composition is applied to the fibers 102 accumulated on a shaped conveyor belt surface, straight or curved, to form a web 104 having a shape formed by and conforming to the shape of the conveyor belt surface. When hardened, the binder composition render the binder coated fibers 102 sufficiently stiff to retain the web 104 with a shape as formed. For example, the binder coated fibers 102 form a flat web 104 to provide a flat major surface of a gypsum board or cement board. According to embodiments of the invention, the foldable portions 116 of at least some of the fibers 102 have less binder composition thereon to increase its flexure while folded, and preferably have substantially or essentially all of the binder composition removed, so as to form a crease while folded and creased. The foldable portions 116 are in the section 110 of the web 104 that is foldable.

The web 104 avoids having a rough texture that is irritating to human skin, particularly where tips of the fibers 102 are exposed, and particularly where the fibers 102 are exposed at the surface of the web 104 and are prickly to the touch. Accordingly, a non-irritating binder composition 114 coats the fibers 102. An embodiment of a non-irritating binder composition 114 comprises 3-10 grams of a matting agent, for example, a polymethyl urea resin with about 0.6% reactive methyl groups and primary particles of about 0.1 to 0.15 mμm. forming agglomerates of about 3.5 to 6.5 mμm. diameter, and a 20% solids solution of GP Resi-Mat, a urea formaldehyde copolymer forming resin soluble in water, as a binder for wet laid glass fiber mat, a commercial product of Georgia-Pacific Building Products, Atlanta, Ga. The preferred solid is marketed as PERGOPAK m5 a trademark of Albemarle Corporation, which refers to a polymethyl urea resin having a water content of 15 weight % $H_2O$ corresponding to the m5 designation and forming a thermosetting urea-formaldehyde copolymer, condensation product or reaction product.

Alternatively, a non-formaldehyde fluid binder composition 114 comprises Acrodur 950 L, a water soluble thermosetting acrylic polymer binder cut to a range of 15%-25% solids from 50%-55% solids, for example, 200 g of water as a solvent for 200 g of Acrodur.

Figure 5:
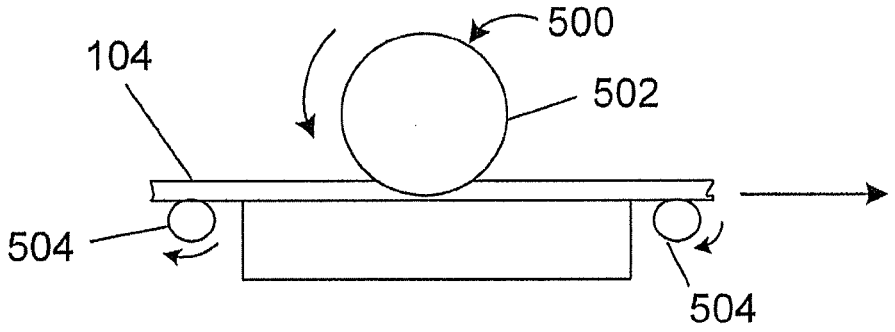
FIG. 5 is a schematic view of a slitting apparatus of a manufacturing system and apparatus.

According to an embodiment of the invention, the web 104 for use as a joint tape 100 is preferably about equal to the width of a paper joint tape. FIG. 5 discloses another embodiment of the invention, wherein the web 104 is conveyed through a slitter apparatus 500. The web 104 is conveyed by a tow chain or by industry standard conveyors 504. A slitting blade 502 is disclosed, which may be circular or flat. The slitting blade 502 slits the web 104 lengthwise to a desired width corresponding to the width of a wallboard joint tape, preferably about equal to the width of a paper joint tape or less than the width of a paper joint tape, to substitute for paper joint tape in applicator tooling. Slitting with a sharp blade would leave sharp edges on the severed fibers 102, which would provide a source of skin irritation. Accordingly, the slitter apparatus 500 has a blunt edge slitting blade 502 to slit through the web 104, while the blunt edge makes crushed edges on the fiber ends along the sections 106, 108, FIG. 1, of the web 104. The crushed edges are less irritating to skin than are sharp edges. Depending upon the overall width of the conveyed web 104, the slitter apparatus has a sufficient number of blades 502 to slit the web 104 lengthwise to form one or more joint tapes 100, side by side. Further, the vacuum table 326 is provided with one or more lengthwise slots 400 corresponding to the number of central sections 110 of respective joint tapes 100 to be manufactured, side by side. Further, the vacuum table 326 is provided with one or more lengthwise slots 400 corresponding to the number of foldable portions 116 are intended for the same single reinforcement web 104 of the type disclosed by FIG. 7 below. The slitter apparatus 500 slits the web 104 to form the lengthwise lateral sections 106, 108 adjoining each lengthwise central section 110. Preferably the central section 110 is equidistant from lateral edges of the web 104. The tape 100 is rolled up on itself to provide a roll 200 of tape. Thereafter, the tape 100 is dispensed by unrolling from the roll 200, either by hand operation or by tooling operation.

Figure 6:
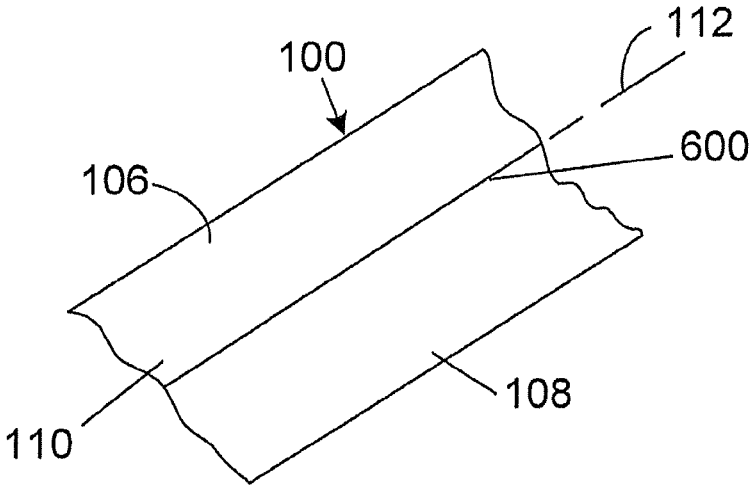
FIG. 6 is a schematic view of a second embodiment of a reinforcement tape.

FIG. 6 discloses another embodiment of the invention, wherein the tape 100 is provided with a fold line 600 that provides a guide for folding the tape 100 with ease. The tape 100 is folded along the central longitudinal axis 112 to provide a crease 600 along the tape axis. The tape 100 is then unfolded for the crease 600 to lie essentially flat and provide a fold line. Further, the unfolded tape 100 is rolled up on itself to provide a roll 200 of tape, as in FIG. 2, having a fold line 600 as a guide for folding and creasing the tape 100 in the future. Thereafter, the tape 100 is dispensed by unrolling from the roll, either by hand operation or by tooling operation. The fold line 600 provides a guide for folding the tape 100 with ease along the fold line 600 to conform the tape 100 to an inside corner in preparation for imbedding in a wall board joint. The tape 100 can be folded, for example, ninety degrees, and return to its original flat shape without losing tensile strength. By removing the binder in the anticipated foldable portions 116, the fibers are free of the binder and are free to flex without fracturing in response to being folded. This feature differs from tapes in which their fibers are held by a binder, which resists flexure of the fibers, and which causes the fibers to become weakened or fractured when the fibers are flexed. The fibers in the foldable portions 116 of the lengthwise central section 110 extend into the binder coated lateral sections 106, 108 for the binder to bond the fibers to other fibers in the tape 100, and to resist pull-out of the fibers from a hardened joint compound. Further, a hardened joint compound adheres to the fibers that bridge across the foldable portions 116 to the binder coated lateral sections 106, 108 to reinforce the joint compound and provide resistance to cracking.

Figure 7:
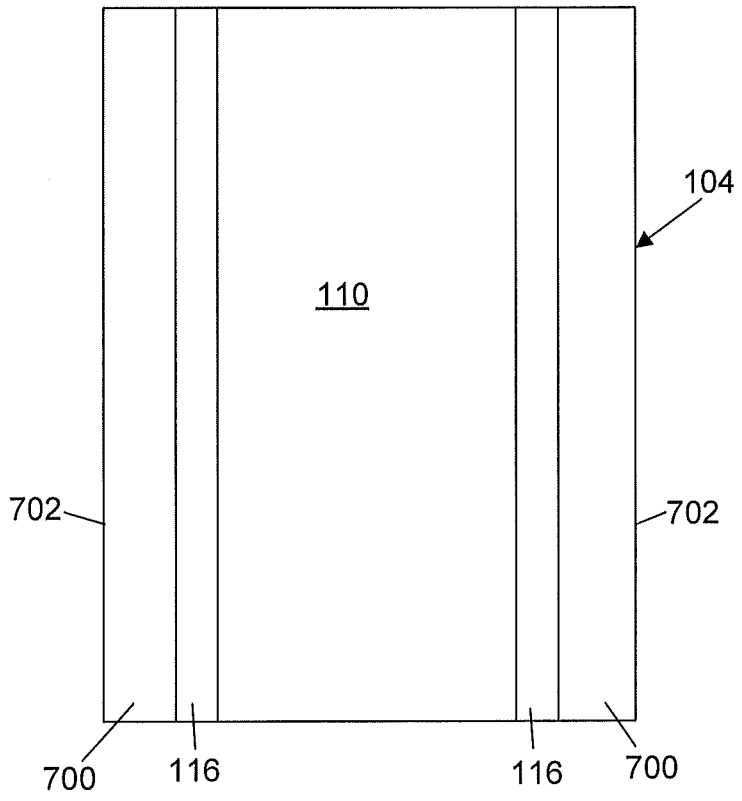
FIG. 7 is a schematic view of another embodiment of a reinforcement web.

FIG. 7 discloses an alternative embodiment of a reinforcement web 104 to imbed at least partially in a surface of a cementitious material, for example, a cementitious board formed by hardening a slurry of a gypsum mixture or portland cement mixture or in situ foamed polymeric material. The reinforcement web 104 provides a facing or facing layer of the cementitious material. According to an alternative embodiment of the invention, the fibers of the reinforcement web are fabricated of polymeric material, AR glass fibers or an alkali resistant polymer coating applied to chopped glass fibers intended to imbed at least partially in alkaline cementitious material, for example, portland cement. The reinforcement web 104 has a flat central section 110 of binder coated fibers 102 to form a flat surface of a wallboard. Adjacent to and contiguous with the central section 110, the reinforcement web 104 has lengthwise foldable portions 116, wherein at least some of the binder composition 114 is removed from at least some of the foldable portions 116 of the fibers 102 to increase flexure and reduce stiffness thereof by reducing the amount of binder composition 114. Alternatively, removing substantially or essentially all of the binder composition 114 from such foldable portions 116 permits folding and creasing of the foldable portions 116. The foldable sections are adjacent to lateral web sections 700 adjacent to respective lateral edges 702 of the web 104. The web sections 700 are coated with the binder composition 114, or alternatively, the binder composition 114 is removed partially or fully removed to adjust the flexure and/or foldability of the web sections 700.

Figure 8:
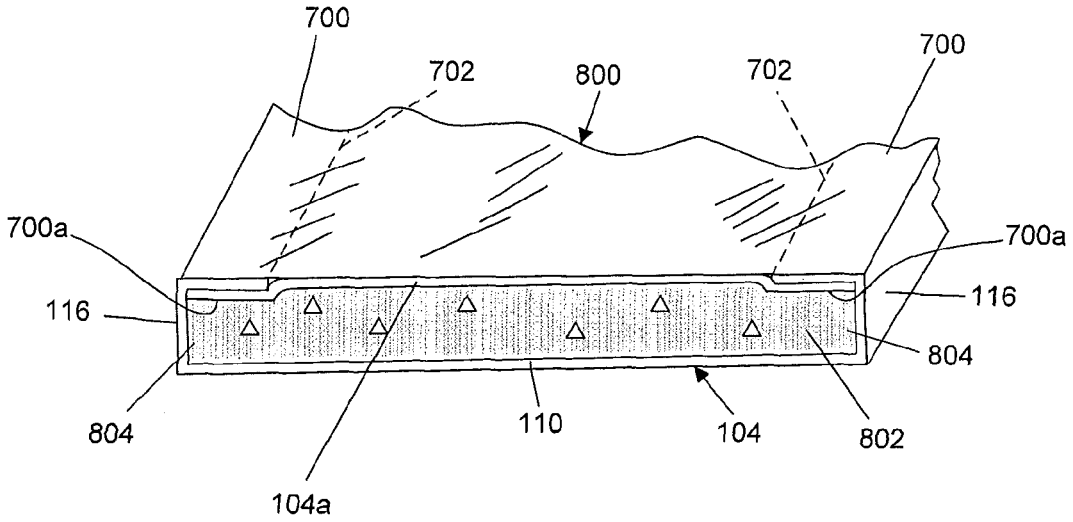
FIG. 8 is a schematic view of the reinforcing web of FIG. 7 providing a facing on a cementitious material to form a board.

FIG. 8 discloses a cementitious composite material 802 forming a facing layer of a cementitious board 800 reinforced by the reinforcement web 104 of FIG. 7. The entire web 104 is at least partially imbedded in the cementitious material 802 that is hardened from a slurry form. The foldable portions 116 are of reduced flexure to fold in conformity with the lateral edges 804 of the board 800. The flexure is increased by removal of a corresponding amount of at least some of the binder composition 114 from the foldable portions 116. When sharply defined corner edges of the board 800 are desired, the foldable portions 116 are capable of wrapping around the edges and creasing along each of the foldable portions 116 by removal of substantially or essentially all of the binder from the foldable portions 116. The foldable portions 116 are folded by flexure thereof to wrap by flexure around corresponding edges 804 of the board 800 to reinforce the edges 802 against damage due to impact or thermal expansion and contraction. Further, the foldable portions 116 are foldable with creases to form substantially or essentially sharp edges 804 on the board 800. Alternatively, the foldable portions 116 are foldable without creases for the edges 804 on the board 800 to have rounded configurations. A flat central section 110 of the web 104 covers a flat major surface of the board 800. The opposite major surface of the board 800 is covered by another reinforcement web **104*a* that is at least partially embedded in the cementitious material 802. The web sections 700 of the web 104 overlap and cover corresponding edge sections 700*a* of the other reinforcement web 104*a*, and the overlapped sections 700 and 700*a* are at least partially imbedded in the cementitious material 802**.

To support the claims of increased foldability/flexibility, three different tests were conducted; Gurley Stiffness, Strength after bending, and ASTM D790-84a Standard Test Methods for Flexural Properties of Un-reinforced and Reinforced Plastics and Electrical Insulating Materials.

In three tests; Gurley Stiffness, Strength after bending, and ASTM D790-84a (Flexural Strength) the glass fiber mat with the "folding Point" or seam or reduced binder area showed results consistent with the mat being more flexible/foldable than a standard glass mat of equal weight and thickness.

For the Gurley stiffness test a standard glass mat was tested against a glass mat with a "folding point" or seam or area with reduced binder. A typical Gurley Stiffness testing apparatus was used. The glass mat with seam shows a Gurley Stiffness of 106.47 which is lower than the glass mat without seam 257.43. Using Statistical Analysis a one-way ANOVA shows a statistically significant difference or P value of less than 0.05. With the glass mat with seam being less stiff/more flexible than the glass mat without the seam.

TABLE 1

Gurley Stiffness Test

| Sample # | 0.9 lb Glass Mat With Seam | 0.9 lb Glass Mat without Seam |
|---|---|---|
| 1 | 105.64 | 222.40 |
| 2 | 113.98 | 227.96 |
| 3 | 100.08 | 233.52 |
| 4 | 100.08 | 278.00 |
| 5 | 105.64 | 333.60 |
| 6 | 100.08 | 250.20 |
| 7 | 88.96 | 305.80 |
| 8 | 166.80 | 183.48 |
| 9 | 100.08 | 289.12 |
| 10 | 83.40 | 250.20 |
| Average | 106.47 | 257.43 |

Figure 9:
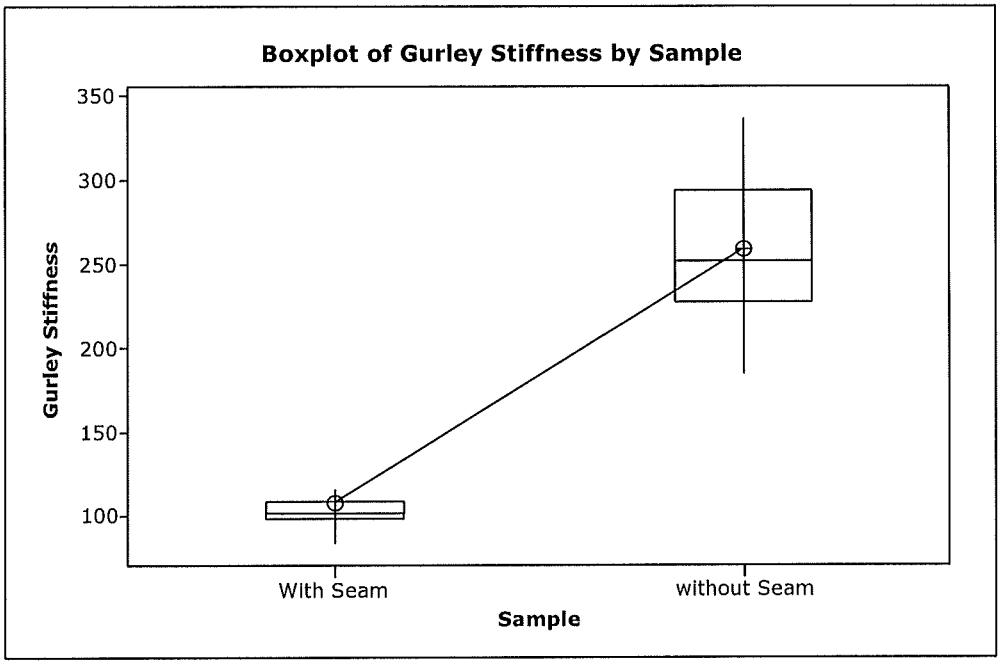
FIG. 9 discloses a boxplot of test data in a test for Gurely Stiffness by Sample.

One-way ANOVA: Gurley Stiffness Versus Sample See Boxplot Fig. 9

| Source | DF | SS | MS | F | P |
|---|---|---|---|---|---|
| Sample | 1 | 113936 | 113936 | 91.11 | 0.000 |
| Error | 18 | 22509 | 1250 | | |
| Total | 19 | 136445 | | | |

S = 35.36 R-Sq = 83.50% R-Sq (adj) = 82.59%

Individual 95% CIs For Mean Based on Pooled StDev

| Level | N | Mean | StDev | ---+---------+---------+---------+------ |
|---|---|---|---|---|
| With Seam | 10 | 106.47 | 22.85 | (---*----) |
| without Seam | 10 | 257.43 | 44.48 | (---*----) |
| | | | | ---+---------+---------+---------+------ |
| | | | | 100 150 200 250 |

Pooled StDev = 35.36

For the Strength After Bending Test a standard glass mat was tested against a glass mat with a "folding point" or seam or area with reduced binder. Samples were tested before and after bending 180°. The samples with the binder reduced area showed a 34.53% loss of strength which was lower by almost half of the standard glass mat at 64.38%.

TABLE 2

Strength After Bending Test

| Sample | Tensile Strength (lbf) With Seam | Tensile Strength (lbf) Without Seam |
|---|---|---|
| 0 Deg | 20.23 | 28.18 |
| 0 Deg | 21.65 | 29.09 |
| 0 Deg | 19.00 | 20.31 |
| 0 Deg | 20.06 | 21.50 |
| 0 Deg | 14.14 | 22.84 |
| 0 Deg | 15.86 | 22.67 |
| 0 Deg | 19.60 | 26.35 |
| 0 Deg | 16.10 | 21.21 |
| Average | 18.33 | 24.02 |
| 180 Deg | 7.98 | 6.28 |
| 180 Deg | 15.16 | 7.81 |
| 180 Deg | 12.79 | 9.58 |
| 180 Deg | 11.83 | 9.71 |
| 180 Deg | 12.04 | 9.80 |
| 180 Deg | 14.42 | 9.75 |
| 180 Deg | 9.24 | 8.17 |
| 180 Deg | 9.22 | 8.63 |
| 180 Deg | 10.50 | 8.56 |
| 180 Deg | 12.58 | 7.27 |
| Average | 11.58 | 8.56 |
| % loss of Strength | 36.85 | 64.38 |

The following discussion refers to the ASTM D 790-84a "Standard Test Methods for Flexural Properties of Unreinforced and Reinforced Plastics and Electrical Insulating Materials." For this test a standard glass mat was tested against a glass mat with a "folding point" or seam or area with reduced binder. The test method used was ASTM D790-84a. And U.S. Pat. No. 5,017,312 states ASTM D790-84a is used as a method used to quantify the flexural properties of a glass reinforced composite material. Procedure A was used with a support span of 30 mm. The rate of crosshead motion was 6.8 mm/minute. The glass mat with seam showed a Flexural Strength of 0.428 MPa lower than the standard glass mat at 0.789 MPa. Using Statistical Analysis a one-way ANOVA shows a statistically significant difference or P value of less than 0.05. The standard glass mat shows a higher Flexural Strength.

TABLE 3

ASTM D790-84a Test Method

| Sample I.D. | Width mm | Thickness mm | Peak Load N | Flexural Strength MPa | Flexural Strength PSI |
|---|---|---|---|---|---|
| GlassMatSeam | 12.7 | 0.194 | 0.017 | 0.310 | 45 |
| GlassMatSeam | 12.7 | 0.232 | 0.025 | 0.382 | 55 |
| GlassMatSeam | 12.7 | 0.224 | 0.033 | 0.522 | 76 |
| GlassMatSeam | 12.7 | 0.234 | 0.025 | 0.379 | 55 |
| GlassMatSeam | 12.7 | 0.210 | 0.033 | 0.557 | 81 |
| GlassMatSeam | 12.7 | 0.236 | 0.028 | 0.420 | 61 |
| Average | | | 0.027 | 0.428 | 62 |
| | | | | | |
| GlassMatControl | 12.7 | 0.290 | 0.063 | 0.770 | 112 |
| GlassMatControl | 12.7 | 0.270 | 0.044 | 0.577 | 84 |
| GlassMatControl | 12.7 | 0.275 | 0.056 | 0.722 | 105 |
| GlassMatControl | 12.7 | 0.250 | 0.048 | 0.680 | 99 |
| GlassMatControl | 12.7 | 0.280 | 0.065 | 0.823 | 119 |
| GlassMatControl | 12.7 | 0.295 | 0.097 | 1.165 | 169 |
| Average | | | 0.062 | 0.789 | 114 |

Figure 10:
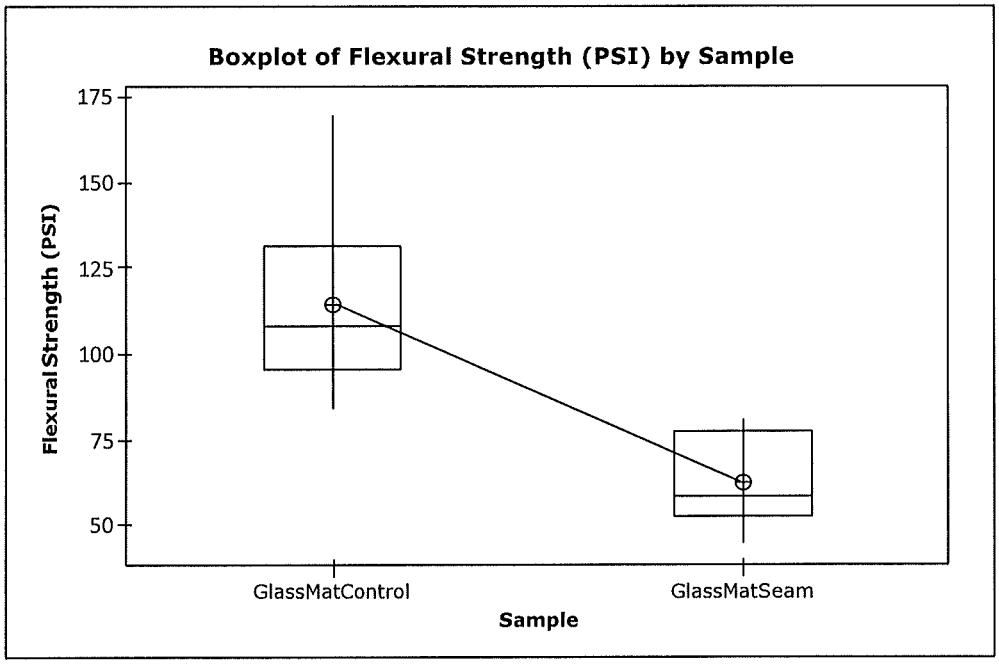
FIG. 10 discloses a boxplot of test data in a test for Flexural Strength (PSI) by Sample.

One-way ANOVA: Flexural Strength (PSI) versus Sample See Boxplot, Fig. 10

| Source | DF | SS | MS | F | P |
|---|---|---|---|---|---|
| Sample | 1 | 8229 | 8229 | 15.78 | 0.003 |
| Error | 10 | 5215 | 522 | | |
| Total | 11 | 13444 | | | |

S = 22.84 R-Sq = 61.21% R-Sq (adj) = 57.33%

Individual 95% CIs For Mean Based on Pooled StDev

| Level | N | Mean | StDev | ---+---------+---------+---------+------ |
|---|---|---|---|---|
| GlassMatControl | 6 | 114.50 | 29.30 | (--------*-------) |
| GlassMatSeam | 6 | 62.13 | 13.59 | (--------*-------) |
| | | | | ---+---------+---------+---------+------ |
| | | | | 50 75 100 125 |

Pooled StDev = 22.84

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Patents, patent applications and publications referred to herein are hereby incorporated by reference in their entireties. Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A foldable reinforcing tape for imbedding in a cementitious material, comprising:

multiple fibers joined together by a binder composition and forming a thin, non-woven web, wherein the thin, non-woven web comprises openings for passage of the cementitious material;

at least some of the fibers having one or more foldable portions, wherein the foldable portions extend in a lengthwise central section of the thin, non-woven web, and wherein the lengthwise central section comprises a width of between about 1 mm and about 3 mm; and the foldable portions having substantially less binder composition thereon to form a crease when folded; and wherein the tape comprises a crease in the lengthwise central section.

2. The foldable reinforcing tape of claim 1, wherein the foldable portions are substantially free of the binder composition.

3. The foldable reinforcing tape of claim 1, wherein the lengthwise central section is foldable to form the crease for conformance to an inside corner.

4. The foldable reinforcing tape of claim 1, wherein the joined together fibers extend in multiple directions in the thin, non-woven web to resist tensile forces exerted in the multiple directions.

5. The foldable reinforcing tape of claim 1, wherein the lengths of the fibers are greater than the width of the lengthwise central section of the thin, non-woven web, and less than the width of the thin, non-woven web.

6. The foldable reinforcing tape of claim 1, wherein the thin, non-woven web is rolled up on itself to form a roll.

7. The foldable reinforcing tape of claim 1, wherein the binder composition comprises a thermosetting polymer.

8. The foldable reinforcing tape of claim 7, wherein the binder composition comprises a urea-formaldehyde copolymer or an acrylic polymer.

9. The foldable reinforcing tape of claim 1, wherein the binder composition is formaldehyde free.

10. The foldable reinforcing tape of claim 1, wherein the binder composition is non-irritating to a person's skin.

11. The foldable reinforcing tape of claim 1, wherein the fibers comprise water resistant material.

12. The foldable reinforcing tape of claim 1, wherein a thickness of the tape is from about 0.18 mm to 0.236 mm.

13. The foldable reinforcing tape of claim 1, wherein the lengthwise central section is foldable to conform to a wallboard joint at an inside corner.

14. The foldable reinforcing tape of claim 1, wherein the openings of the thin, non-woven web permit the escape of air from being trapped behind the web during formation of a wallboard joint.

15. A method of making the foldable reinforcing tape of claim 1, comprising:

assembling reinforcement fibers to form a precursor of a web;

dispersing a binder composition among the fibers either before or after the fibers form the precursor;

varying the amount of the binder composition in respective sections of the precursor, wherein different sections of the precursor have different amounts of the dispersed binder composition; and curing the binder composition to form the web having the fibers joined together by a cured binder composition, wherein different sections of the web have different amounts of the cured binder composition to adjust flexibility of the different sections of the web;

the method being configured to make the product of claim 1.

16. The method of claim 15, comprising:

dispersing the binder composition among the fibers either before or after assembling the fibers to form the precursor; and varying the amount of the binder composition in the respective sections of the precursor by removing portions of the binder composition from the respective sections of the precursor.

17. The method of claim 15, comprising:

varying the amount of the binder composition in the respective sections of the precursor by dispersing adjusted amounts of the binder composition among the fibers forming the respective sections of the precursor.

18. The method of claim 15, comprising:

dispersing the binder composition among the fibers either before or after assembling the fibers to form the precursor and varying the amount of the binder composition in the respective sections of the precursor, either by removing portions of the binder composition from the respective sections of the precursor, or by dispersing adjusted amounts of the binder composition among the fibers forming the respective sections of the precursor.

19. The method of claim 15, comprising:

dispersing the binder composition among the fibers before assembling the fibers to form the precursor.

20. The method of claim 15, comprising:

dispersing the binder composition among the fibers after assembling the fibers to form the precursor.

21. The method of claim 15, comprising:

varying the amount of the binder composition in respective sections of the precursor by distributing a decreased binder composition mass per fiber unit volume among the fibers forming at least a section of the precursor, to provide the web with a section capable of bending with a radius of curvature inversely proportional to binder composition mass per fiber unit volume.

22. The method of claim 15, comprising:

varying the amount of the binder composition in respective sections of the precursor to provide at least a section of the precursor substantially without the binder composition and to provide the web with a foldable and creasable section of the web substantially without the binder composition.

23. The method of claim 15, comprising:

forming the web with at least a section of the web having a reduced amount of a cured binder composition.

24. The method of claim 15, comprising:

forming the web with at least a section of the web having a reduced amount of the cured binder composition, wherein the section is adjacent to at least a section of the web comprised of respective fibers bonded together by at least some of the cured binder composition.

25. The method of claim 15, comprising:

forming the web with at least a section of the web having the reduced amount of the cured binder composition, wherein the section is between at least two sections of the web comprised of respective fibers bonded together by at least some of the cured binder composition.

26. The method of claim 15, comprising:

varying the amount of the binder composition in respective sections of the precursor, by removing substantially all of the binder composition from a lengthwise central section of the web, wherein the web has a thickness of about 0.18 mm, and a width of about 5 mm to substitute for a paper tape to fabricate a wallboard joint, and the lengthwise central section of the web is foldable to conform to a wallboard joint at an inside corner.

27. The method of claim 15, comprising:

varying the amount of the binder composition in respective sections of the precursor, by dispersing the binder composition among the fibers excluding the fibers in a lengthwise central section of the web, wherein the web has a thickness of about 0.18 mm, and a width of about 5 mm to substitute for a paper tape to fabricate a wallboard joint, and the lengthwise central section of the web is foldable to conform to a wallboard joint at an inside corner.

28. The method of claim 15, comprising:

varying the amount of the binder composition in respective sections of the precursor, by removing substantially all of the binder composition from lengthwise sections of the web that are foldable to cover corresponding edges of a gypsum wallboard.

29. The method of claim 15, comprising:

varying the amount of the binder composition in respective sections of the precursor, by dispersing the binder composition among the fibers excluding the fibers in lengthwise sections of the web that are foldable to cover corresponding edges of a wallboard.

* * * * *